US011533791B2

(12) United States Patent
Galindo Perez et al.

(10) Patent No.: US 11,533,791 B2
(45) Date of Patent: Dec. 20, 2022

(54) DOMESTIC APPLIANCE

(71) Applicant: BSH Hausgeräte GmbH, Munich (DE)

(72) Inventors: Juan Jose Galindo Perez, Saragossa (ES); Carlos Obon Abadia, Saragossa (ES); Alvaro Rigual Iturria, Saragossa (ES); Pablo Ruiz Arnal, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 380 days.

(21) Appl. No.: 16/486,162

(22) PCT Filed: Mar. 9, 2018

(86) PCT No.: PCT/IB2018/051555
§ 371 (c)(1),
(2) Date: Aug. 15, 2019

(87) PCT Pub. No.: WO2018/172878
PCT Pub. Date: Sep. 27, 2018

(65) Prior Publication Data

US 2019/0373685 A1 Dec. 5, 2019

(30) Foreign Application Priority Data

Mar. 20, 2017 (ES) ..... P201730374

(51) Int. Cl.
*H05B 6/12* (2006.01)

(52) U.S. Cl.
CPC ..... *H05B 6/129* (2013.01)

(58) Field of Classification Search
CPC ..... H05B 6/129; H05B 3/68; H05B 1/0266; H05B 3/026; H05B 3/748; A47J 27/004
USPC ..... 219/620
See application file for complete search history.

(56) References Cited

U.S. PATENT DOCUMENTS 3,790,735 A * 2/1974 Peters, Jr. ..... H05B 6/129 219/622
5,134,265 A * 7/1992 Dickens ..... H05B 6/1272 99/451
6,034,876 A * 3/2000 Ohno ..... H01R 12/724 361/752

(Continued)

FOREIGN PATENT DOCUMENTS

EP 1213186 A2 6/2002
EP 2164298 A1 3/2010

(Continued)

OTHER PUBLICATIONS

International Search Report PCT/IB2018/051555 dated Jun. 18, 2018.

(Continued)

*Primary Examiner* — Ibrahime A Abraham
*Assistant Examiner* — Frederick F Calvetti
(74) *Attorney, Agent, or Firm* — Michael E. Tschupp; Andre Pallapies; Brandon G. Braun

(57) ABSTRACT

A household appliance device includes a base unit, a planar unit, and a fixing unit configured to at least partially fix the planar unit to the base unit such that in an assembled state the fixing unit allows restricted movement at least of a part of the planar unit relative to the base unit in a direction of movement at least essentially parallel to a main plane of extension of the planar unit.

22 Claims, 5 Drawing Sheets

(56) References Cited

U.S. PATENT DOCUMENTS 6,037,572 A * 3/2000 Coates ..... H05B 3/26 219/451.1
6,191,391 B1 * 2/2001 Deo ..... F24C 15/18 126/273 R
7,786,414 B2 * 8/2010 Schilling ..... H05B 6/1263 219/622
8,610,040 B2 * 12/2013 Farachi ..... H05B 6/129 219/600
8,916,801 B2 * 12/2014 Harward ..... H05B 3/265 219/385
9,854,812 B2 * 1/2018 Haas ..... A21C 15/00
10,342,075 B2 * 7/2019 Lomp ..... H05B 6/1209
10,440,781 B2 * 10/2019 Gaulard ..... H05B 3/72
10,920,992 B2 * 2/2021 Kobayashi ..... H05B 6/12
2004/0144773 A1 * 7/2004 Kim ..... H05B 6/6482 219/601
2006/0065654 A1 * 3/2006 Ptasienski ..... H05B 3/86 219/543
2007/0278215 A1 12/2007 Schilling
2010/0059513 A1 * 3/2010 Farachi ..... H05B 6/129 219/756
2012/0318785 A1 * 12/2012 Kushihashi ..... H05B 3/143 219/548
2013/0319996 A1 * 12/2013 Harward ..... H05B 3/265 219/408
2014/0076176 A1 3/2014 Haas
2016/0007414 A1 * 1/2016 Jeanneteau ..... H05B 6/1263 219/622
2016/0219651 A1 * 7/2016 Gaulard ..... H05B 3/72
2016/0366726 A1 12/2016 Lomp et al.
2020/0224882 A1 * 7/2020 Kim ..... H02J 50/10
2020/0229276 A1 * 7/2020 Kim ..... A47J 37/0629

FOREIGN PATENT DOCUMENTS

FR 2756599 A1 6/1998
JP 2003217806 A 7/2003

OTHER PUBLICATIONS

National Search Report ES 201730374 dated Jun. 8, 2017.
Report of Examination EP18717417.2 dated Jul. 8, 2021.
Report of Examination CN 201880019534.5 dated Sep. 28, 2021.

* cited by examiner

DOMESTIC APPLIANCE

CROSS-REFERENCES TO RELATED APPLICATIONS

This application is the U.S. National Stage of International Application No. PCT/IB2018/051555, filed Mar. 9, 2018, which designated the United States and has been published as International Publication No. WO 2018/172878 A1 and which claims the priority of Spanish Patent Application, Serial No. P201730374, filed Mar. 20, 2017, pursuant to 35 U.S.C. 119(a)-(d).

BACKGROUND OF THE INVENTION

The invention relates to a household appliance device.

Induction ovens are known from the prior art for example, which have a planar induction heating unit, which is fixed in an immovable manner to a muffle by means of a rivet connection and/or screw connection. However during a heating operation such an immovable fixing of the induction heating unit leads to stresses in the induction heating unit, in particular as a result of a thermal deformation of the induction heating unit and the muffle, by means of which on the one hand material stress is increased and on the other heating performance is reduced as a result of a changed distance between the induction heating unit and the muffle.

BRIEF SUMMARY OF THE INVENTION

The object of the invention is in particular to provide a generic device with improved properties in respect of efficiency.

The invention is based on a household appliance device, in particular a cooking appliance device, with a fixing unit, which is provided to fix a planar unit to a base unit at least partially and in particular at least for the most part.

It is recommended that in at least an assembled state the fixing unit allows restricted movement at least of a part, in particular at least of a major part of the planar unit relative to the base unit in a direction of movement at least essentially parallel to a main plane of extension of the planar unit. By means of this embodiment a household appliance device with improved properties in respect of efficiency, in particular assembly efficiency, maintenance efficiency, material efficiency, performance efficiency and/or cost efficiency, can be provided. In addition, advantageous flexibility, in particular assembly flexibility and/or a flexibility of fixing, can in particular be achieved. Furthermore, operating safety and/or reliability can advantageously be improved. In addition component deformations and/or component stresses, for example component tensions and/or component wear, can advantageously be avoided, by means of which in particular downtime and/or durability can be improved.

In this connection a "household appliance device" should in particular be understood to mean at least a part, in particular a subassembly, of a household appliance. The household appliance is here advantageously embodied as a cooking appliance, in particular as a cooktop, as a grill appliance, as a microwave oven and/or preferably as an oven. The household appliance is particularly advantageously embodied as an induction cooking appliance, in particular as an induction cooktop, as an induction grill appliance, as an induction microwave oven and/or particularly preferably as an induction oven. In particular the household appliance device can also comprise the base unit and/or the planar unit. The word "provided" should in particular be understood to mean specially designed and/or equipped. That an object is provided for a particular function should in particular be understood to mean that the object fulfills and/or performs this particular function in at least one usage and/or operating status. In addition a "major part of an object" should in particular be understood to mean a part of the object which embodies at least 55%, advantageously at least 65%, preferably at least 75%, particularly preferably at least 85% and particularly advantageously at least 95% of a volume and/or mass of the object. Furthermore the expression "at least for the major part" should in particular be understood to mean at least 55%, advantageously at least 65%, preferably at least 75%, particularly preferably at least 85% and particularly advantageously at least 95%.

A "base unit" should further in particular be understood to mean a unit which defines and/or embodies at least one part and preferably at least a major part of the household appliance. The base unit is here advantageously embodied as a support unit and in particular provided to support the planar unit and particularly advantageously further objects. Furthermore a "planar unit" should here in particular be understood to mean a unit separately embodied from the base unit, which in at least one operating status is provided to carry out at least one function, in particular associated with the household appliance. The function can here be any desired function, such as for example a storage function, an insulation function, a barrier function, a lighting function, a heat conduction function and/or heating function. Furthermore the term "planar" should in particular be understood to mean an object in the case of which a largest lateral surface of a smallest, in particular notional cuboid, which only just completely encloses the object, is at least 50%, advantageously at least 100%, preferably at least 200% and particularly preferably at least 500% larger than a lateral surface of the cuboid which is arranged perpendicularly to each largest lateral surface. In addition in this connection a "fixing unit" should in particular be understood to mean a unit, advantageously at least partially separately embodied from the planar unit and/or the base unit, which is provided to connect the base unit and the planar unit to each other, in particular in a force- and/or form-fitted manner and advantageously by means of at least one rivet connection, at least one bayonet connection, at least one snap-in connection, one plug-in connection and/or at least one screw connection. To this end the fixing unit advantageously has at least one fixing element and preferably a multiplicity of fixing elements, which in particular can interact for an at least partial fixing of the planar unit and the base unit.

A "restricted movement" should furthermore in particular be understood to mean a movement in at least one direction of movement, which is limited to a predetermined, advantageously rectilinear movement path, in the direction of movement. The movement path is advantageously predetermined by a shape, size, orientation and/or arrangement at least of a movement-restriction element and/or stop element. In addition, the "main plane of extension" of an object should in particular be understood to mean a plane which is parallel to a largest lateral face of a smallest, in particular notional, cuboid, which only just completely encloses the object, and which in particular runs through a central point, in particular a geometric central point, of the cuboid. Furthermore, "at least essentially parallel" should in particular be understood to mean an orientation of a direction relative to a reference plane and/or a reference direction, in particular in a plane wherein the direction has a variance relative to the reference plane and/or reference direction in particular of less than 8°, advantageously less than 4° and particularly advantageously less than 2°.

In particular in order to achieve great flexibility, in particular great flexibility of movement, and/or to minimize vibrations and/or in particular component tension caused by thermal expansion, it is recommended that a maximum movement path of the part of the planar unit relative to the base unit in the direction of movement amounts to at least 1 mm, preferably at least 2 mm and advantageously at least 3 mm, and/or at most 10 mm, preferably at most 7 mm and advantageously at most 5 mm. A "maximum movement path" should in particular be understood to mean a largest value of a movement path of the restricted movement allowed by the fixing unit.

It is further recommended that in the assembled state the fixing unit allows a restricted movement at least of a first further part, in particular at least of a first further major part of the planar unit relative to the base unit in a further direction of movement at least essentially parallel to the main plane of extension of the planar unit and different to the direction of movement. Flexibility, in particular flexibility of movement and/or movability, can thereby in particular be increased, and/or vibrations, component tension and/or component deformations reduced. In particular the first further part of the planar unit and the part of the planar unit can be identical. Preferably however, the first further part of the planar unit is at least partially different from the part of the planar unit. The further direction of movement is preferably arranged at least essentially perpendicularly to the direction of movement. In particular a maximum movement path of the first further part of the planar unit relative to the base unit in the further direction of movement amounts to at least 1 mm, preferably at least 2 mm and advantageously at least 3 mm, and/or at most 10 mm, preferably at most 7 mm and advantageously at most 5 mm. In this connection the expression "at least essentially perpendicular" should in particular define an orientation of a direction relative to a reference direction, wherein in particular viewed in a plane the direction and the reference direction enclose an angle in particular between 82° and 98°, advantageously between 85° and 95° and particularly preferably between 88° and 92°.

It is additionally recommended that in the assembled state the fixing unit at least essentially fixes a second further part of the planar unit relative to the base unit, in particular different from the part of the planar unit and the first further part of the planar unit, in particular in the direction of movement and/or the further direction of movement. A movement of the planar unit can hereby in particular advantageously be monitored. Here "at least essentially fixes" should in particular be understood to mean a fixing in at least one direction with a maximum movement path of at most 0.5 mm, advantageously at most 0.2 mm and particularly preferably at most 0.1 mm.

In a further embodiment of the invention it is recommended that the fixing unit is provided to fix the planar unit to the base unit in a fixing direction oriented perpendicularly to the main plane of extension of the planar unit. An advantageously efficient fixing, in particular independent of the restricted movement, can thereby in particular be achieved. In particular the fixing unit is provided to regulate, in particular to limit and advantageously at least essentially to keep constant a minimal gap of the planar unit to the base unit. In particular the fixing unit can fix the planar unit to the base unit in the fixing direction with play, in particular of at most 2 mm, preferably at most 1 mm, advantageously at most 0.5 mm and particularly preferably at most 0.25 mm. Advantageously however the fixing unit is provided to fix the planar unit to the base unit in a form-fitted manner in the fixing direction. In this connection an "at least essentially constant gap" should in particular be understood to mean that a maximum value of the minimum gap is greater than a minimum value of the minimum gap by at most 50%, in particular at most 25%, advantageously at most 10% and particularly preferably at most 5%.

In particular in order to increase operating safety, it is recommended that the fixing unit consists at least partially of an electrically insulating material, in particular a plastic and/or advantageously a mica material. Here at least one surface layer of the fixing unit preferably consists at least for the most part and preferably completely of the electrically insulating material. Furthermore the surface layer of the fixing unit can in particular consist at least partially of a material that reduces static friction and/or dynamic friction.

In addition it is recommended that the fixing unit is embodied at least partially in one piece with the base unit. In particular a high level of stability and/or an advantageous assembly efficiency can hereby be achieved. In this connection that an object is "embodied at least partially in one piece" with a further object should in particular be understood to mean that the objects have at least one common component and/or at least one component of the object and/or the object is connected and/or embodied in one piece with at least one component of the further object and/or the further object. Preferably however all components of the object are embodied in one piece with at least one component of the further object. In this connection "in one piece" should in particular be understood to mean at least connected in a bonded manner and/or embodied with each other. The bonding can for example be created by means of an adhesive process, a spray process, a welding process, a soldering process and/or another process. In one piece should advantageously be understood to mean formed from one piece and/or in one piece. This one piece is preferably produced from a single blank, a mass and/or a casting, for example in an extrusion procedure, in particular a single- and/or multi-component extrusion procedure, and/or an injection molding procedure, in particular a single- and/or multi-component injection molding procedure.

In particular to enable a high level of efficiency and/or security of restriction of movement, according to a further embodiment of the invention it is recommended that the planar unit has at least one first stop element, in particular a first movement-restriction element, and the fixing unit at least one second stop element assigned to the first stop element, in particular a second movement-restriction element, which interact to restrict the movement of the planar unit. In particular the first stop element and the second stop element interact to restrict movement of the part of the planar unit and/or of the first further part of the planar unit relative to the base unit in the direction of movement and/or the further direction of movement. An impact of the first stop element on the second stop element advantageously brings about the restriction of movement. The first stop element is preferably embodied as a recess in the planar unit and comprises at least one part of the planar unit delimiting the recess. The second stop element is preferably embodied in the form of a bolt and advantageously arranged in such a way that in at least one assembled state the second stop element penetrates the first stop element in the fixing direction. Advantageously at least one, in particular exactly one, first stop element and at least one, in particular exactly one, corresponding second stop element, surrounded in particular free of play and/or in a form-fitted manner by the first stop element, interact to at least essentially fix the second part of the planar unit relative to the base unit.

It is further recommended that the planar unit has a multiplicity of, in particular at least three, advantageously at least four, preferably at least five and particularly preferably at least six first stop elements, arranged at a distance from each other, in particular first movement-restriction elements, which are differently embodied as regards size, shape and/or orientation. A movement can hereby in particular be advantageously monitored and/or oriented. In this case, the fixing unit in particular has a multiplicity of, in particular at least three, advantageously at least four, preferably at least five and particularly preferably at least six second stop elements, in particular second movement-restriction elements, in particular assigned to the first stop elements, which are advantageously embodied at least essentially identical to each other as regards size, shape and/or orientation. In this case the first stop elements are preferably embodied as recesses in the planar unit and comprise at least one part of the planar unit delimiting the respective recess, so that a size, shape and/or orientation of the first stop elements is correlated with an orientation and/or a maximum movement path of the restricted movement of the planar unit relative to the base unit. In particular in order to enable uniform and/or reliable monitoring of the restricted movement, viewed in the fixing direction the first stop elements are advantageously arranged distributed over the entire planar unit. Furthermore viewed in the fixing direction the second stop elements are preferably arranged distributed over the entire base unit.

It is further recommended that the household appliance device has the base unit, which is embodied as a muffle wall, preferably an oven muffle wall and advantageously an induction oven muffle wall. An advantageously efficient and/or flexible household appliance with a cooking compartment can hereby in particular be realized.

It is additionally recommended that the household appliance device has the planar unit, which is embodied as a heating unit, in particular a heating conductor unit and advantageously an induction heating unit. Efficient heating can in particular advantageously be achieved hereby. In this case the planar unit can preferably have at least one heating element, advantageously wound into a spiral form, in particular a heating conductor and advantageously an inductor, and/or at least one insulation element, preferably connected to the heating element and in particular planar in form. The insulation element is here embodied in particular as a thermally insulating and/or advantageously electrically insulating insulation element.

In order to improve operating safety and/or operational monitoring, it is further recommended that the household appliance device has at least one temperature sensor, which is connected to the fixing unit. Advantageously the temperature sensor is thermally coupled with the base unit and advantageously arranged in the area of the second part of the planar unit. Advantageously the temperature sensor is provided to record, to measure and/or to determine a temperature of the base unit in at least one operating status.

Further advantages emerge from the following description of the drawing. The drawing shows five exemplary embodiments of the invention. The drawing, the description and the claims contain numerous features in combination. The person skilled in the art will expediently also consider the features individually, and put them together into sensible further combinations.

BRIEF DESCRIPTION OF THE DRAWINGS

Wherein.

DETAILED DESCRIPTION OF EXEMPLARY EMBODIMENTS OF THE PRESENT INVENTION

Figure 1:
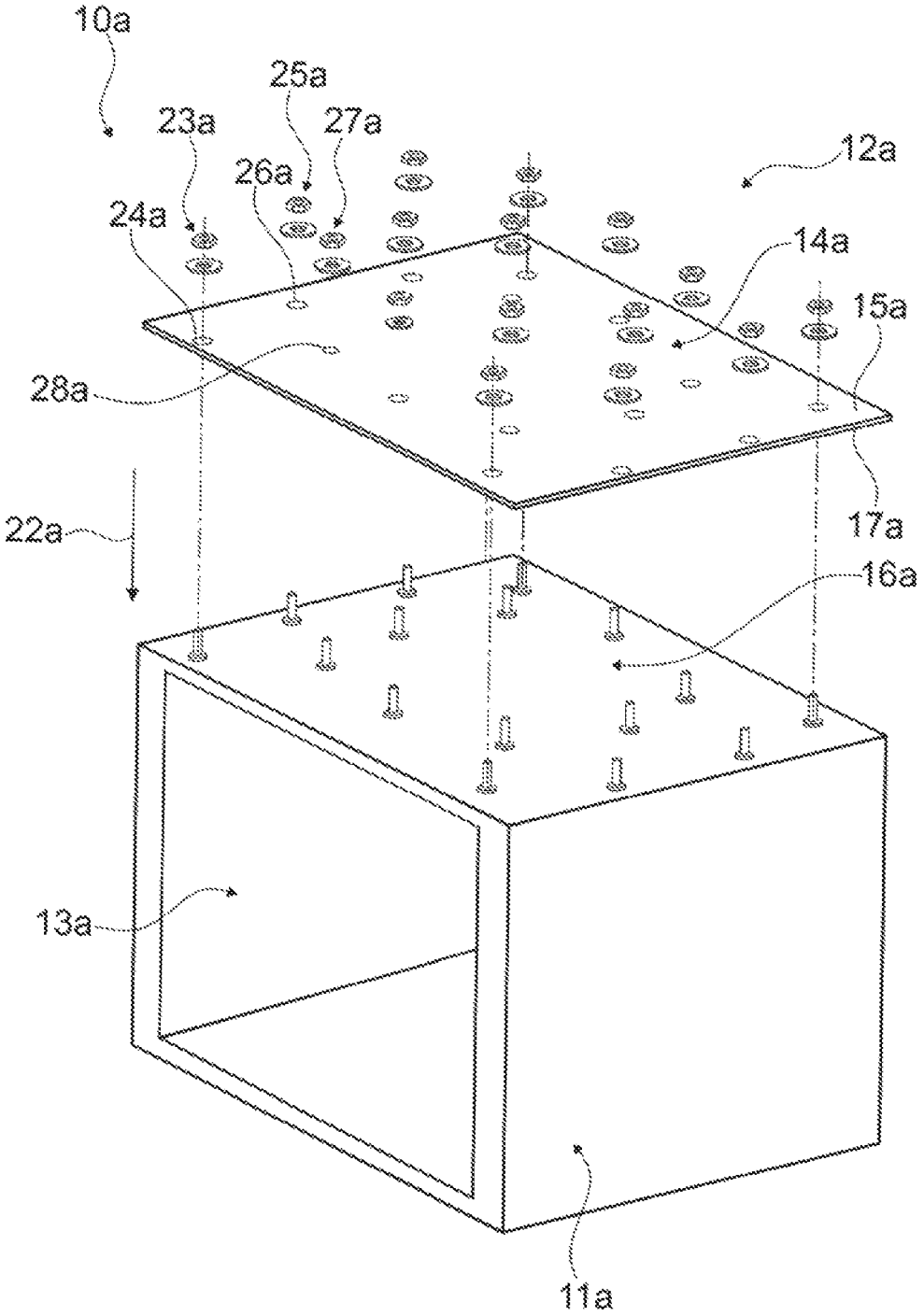
FIG. 1 shows a part of a household appliance by way of example embodied as an induction oven with a household appliance device, which comprises a fixing unit, in an exploded diagram.
Figure 2:
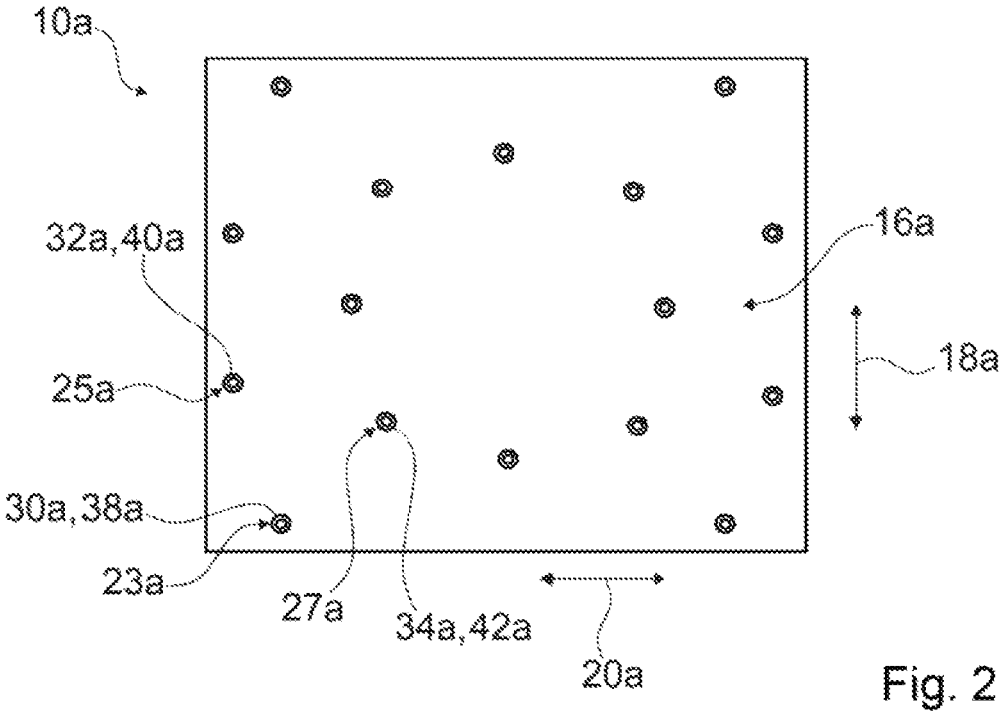
FIG. 2 shows a top view of a base unit of the household appliance device in a disassembled state.

FIG. 1 shows at least one part of a household appliance 10*a* embodied by way of example as a cooking appliance, in a schematic representation. The household appliance 10*a* is embodied as an oven, in the present case in particular as an induction oven. Alternatively, a household appliance could be embodied as a cooktop, in particular an induction cooktop, as a grill appliance, in particular an induction grill appliance and/or as a microwave oven, in particular an induction microwave oven. In principle a household appliance could also be embodied as a further, in particular electrically, alternatively and/or additionally gas-powered and/or oil-powered household appliance. Furthermore a household appliance could be provided to carry out and/or support a cleaning procedure and/or a cooking procedure and/or to keep foodstuffs, in particular under controlled conditions.

The household appliance 10*a* comprises a household appliance device. The household appliance device comprises a muffle 11*a* embodied as an oven muffle. The muffle 11*a* is embodied in a rectangular shape. The muffle 11*a* is provided to delimit a cooking compartment 13*a*. To this end the muffle 11*a* has a multiplicity of muffle walls. In addition, the household appliance 10*a* comprises an external housing (not shown) and an appliance closure element (not shown). In the present case the appliance closure element is embodied as an appliance flap. The appliance closure element is provided to close the cooking compartment 13*a*. Alternatively, a muffle could delimit a multiplicity of areas, for example cooking spaces and/or storage spaces. Furthermore an appliance closure element could also be embodied as an appliance door.

In addition the household appliance device has a base unit 16*a*. The base unit 16*a* is at least essentially embodied in planar form. The base unit 16*a* is embodied as one of the muffle walls. In the present case the base unit 16*a* is embodied as an induction oven muffle wall. The base unit 16*a* is further embodied as a support unit. In the present case the base unit 16*a* is arranged above the cooking compartment 13*a* and therefore, viewed in the gravitational direction, arranged above the cooking compartment 13*a* in particular in an assembled state. A main plane of extension of the base unit 16*a* is further arranged perpendicularly to the gravitational direction.

Alternatively, a base unit could be embodied as an in particular electrical and/or thermal insulation unit, as a barrier unit, as an in particular electrical and/or magnetic shield unit, as a storage unit, as a heating unit, as a lighting unit and/or as a housing unit. In addition, in an assembled state it is conceivable to arrange a base unit underneath and/or to the side of a cooking compartment in the gravitational direction. Furthermore a main plane of extension of a base unit could be oriented parallel or at an angle to the gravitational direction.

The household appliance device additionally comprises a planar unit 14*a*. The planar unit 14*a* is embodied as a heating unit, in the present case in particular an induction heating unit. The planar unit 14*a* has two insulation elements 15*a*, 17*a*. The insulation elements 15*a*, 17*a* are embodied in planar form. Furthermore the insulation elements 15*a*, 17*a* outwardly delimit the planar unit 14*a*. The insulation elements 15*a*, 17*a* are provided to furnish electrical insulation of the planar unit 14*a*. In addition the planar unit 14*a* has at least one inductor (not shown). The inductor is embodied in planar form. The inductor is arranged between the insulation elements 15*a*, 17*a*. In addition, the inductor is connected to the insulation elements 15*a*, 17*a*. In the assembled state the planar unit 14*a* is arranged on the base unit 16*a*.

The planar unit 14*a* has at least one first stop element 24*a*, 26*a*, 28*a*. In the present case the planar unit 14*a* comprises a multiplicity of, by way of example sixteen, first stop elements 24*a*, 26*a*, 28*a*, wherein in particular in FIG. 1 only three of the first stop elements 24*a*, 26*a*, 28*a* are provided with reference characters. The first stop elements 24*a*, 26*a*, 28*a* are arranged at a distance from each other. Viewed perpendicularly to a main plane of extension of the planar unit 14*a*, the first stop elements 24*a*, 26*a*, 28*a* are arranged distributed over the planar unit 14*a*. The first stop elements 24, 26*a*, 28*a* are in each case embodied as a recess in the planar unit 14*a* and comprise at least one part of the planar unit 14*a* delimiting the corresponding recess. In the present case the first stop elements 24*a*, 26*a*, 28*a* are identically embodied as regards size, shape and orientation. In addition, the first stop elements 24*a*, 26*a*, 28*a* are embodied in circular form.

Alternatively, a planar unit could be embodied as a heating unit embodied differently from an induction heating unit, for example a resistance heating unit. In principle it is also conceivable that a planar unit is embodied as an in particular electrical and/or thermal, insulation unit, as a barrier unit, as an in particular electrical and/or magnetic shield unit, as a storage unit, as a support unit, as a lighting unit and/or as a housing unit. Furthermore the planar unit could have a number of insulation elements other than two.

It is also conceivable that a planar unit comprises a number of first stop elements other than sixteen. In addition, a planar unit could have first stop elements which surround recesses only for the most part.

Additionally, the household appliance device comprises a fixing unit 12*a*. The fixing unit 12*a* is embodied in multi-part form. The fixing unit 12*a* is embodied at least partially in one piece with the base unit 16*a*. The fixing unit 12*a* consists at least partially of an electrically insulating material. The fixing unit 12*a* is at least provided to fix the planar unit 14*a* to the base unit 16*a*. The fixing unit 12*a* is provided to fix the planar unit 14*a* to the base unit 16*a* in a fixing direction 22*a*. The fixing unit 12*a* is further provided at least essentially to keep a minimum gap of the planar unit 14*a* to the base unit 16*a* constant. In the present case the fixing unit 12*a* fixes the planar unit 14*a* to the base unit 16*a* in the fixing direction 22*a* in a form-fitted manner.

The fixing unit 12*a* comprises a multiplicity of, in the present case sixteen, fixing subunits 23*a*, 25*a*, 27*a*, wherein in particular for the sake of clarity only three of the fixing subunits 23*a*, 25*a*, 27*a* are provided with reference characters in FIG. 1. The fixing subunits 23*a*, 25*a*, 27*a* are at least essentially structurally identical. The fixing subunits 23*a*, 25*a*, 27*a* are at least partially embodied in one piece with the base unit 16*a*. The fixing subunits 23*a*, 25*a*, 27*a* interact to fix the planar unit 14*a* to the base unit 16*a*. The fixing subunits 23*a*, 25*a*, 27*a* are arranged at a distance from each other. The fixing subunits 23*a*, 25*a*, 27*a* are in the present case embodied as screw connections. Alternatively, a fixing unit could have a number of fixing subunits other than sixteen. Furthermore at least one fixing subunit of the fixing subunits and/or all fixing subunits could be embodied as a rivet connection, as a bayonet connection, as a snap-in connection and/or as a plug-in connection. In principle it is also conceivable that at least one fixing subunit is embodied as a one-piece connection, in particular a soldered connection and/or a welded connection.

Figure 3:
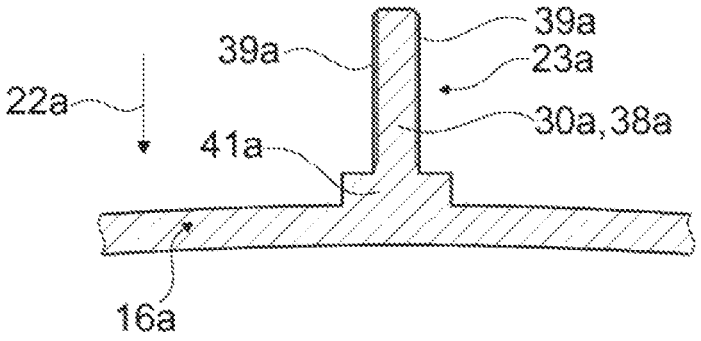
FIG. 3 shows a cutaway representation of a part of the base unit and of a part of the fixing unit in a disassembled state.
Figure 4:
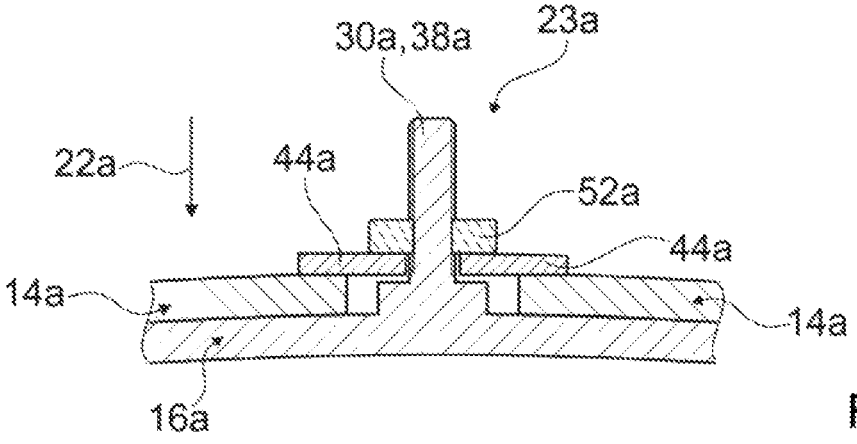
FIG. 4 shows a cutaway representation of the part of the base unit, of a part of a planar unit of the household appliance device and of a part of the fixing unit in an assembled state.
Figure 5:
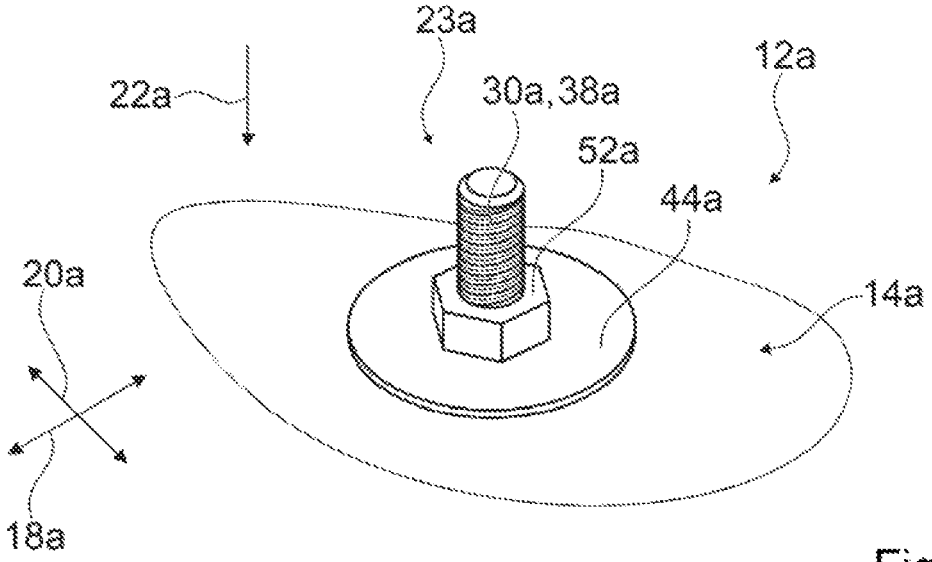
FIG. 5 shows the further part of the fixing unit in the assembled state in a perspective representation.

A fixing subunit 23*a* of the fixing subunits 23*a*, 25*a*, 27*a* and a first fixing element 38*a* of first fixing elements 38*a*, 40*a*, 42*a* are now described below in greater detail below with reference to the FIGS. 3 to 5, wherein the description that follows can also be applied to the other fixing subunits 25*a*, 27*a* and first fixing elements 40*a*, 42*a*, in particular as a result of the at least for the most part structurally identical nature of the fixing subunits 23*a*, 25*a*, 27*a*.

The fixing subunit 23*a* has a first fixing element 38*a*. The first fixing element 38*a* is embodied as an element in the form of a bolt. In the assembled state a longitudinal extension of the first fixing element 38*a* is arranged parallel to the fixing direction 22*a*. The first fixing element 38*a* is connected in one piece with the base unit 16*a*. In the present case the first fixing element 38*a* is welded to the base unit 16*a*. The first fixing element 38*a* here has a head section 41*a* on an end facing towards the base unit 16*a*, which is welded to the base unit 16*a*. In addition the first fixing element 38*a* has an external thread 39*a* on an end facing away from a base unit 16*a*. Alternatively, a fixing unit. a fixing subunit and/or a first fixing element could be embodied separately from a base unit. Furthermore, the fixing unit could be partially glued and/or soldered onto the base unit. A fixing subunit could additionally have a multiplicity of first fixing elements. It is also conceivable that a first fixing element is embodied as a rivet, as a snap-in element, as a spring element, as a stop element and/or as an internal thread element.

The fixing subunit 23*a* further has a second fixing element 44*a*. The second fixing element 44*a* is embodied separately from the first fixing element 38*a*. The second fixing element 44*a* consists of the electrically insulating material. The second fixing element 44*a* is embodied as a disk element, in particular as a washer. In the assembled state, the second fixing element 44*a* completely surrounds the first fixing element 38*a*. In addition, in the assembled state the second fixing element 44*a* is in contact with the planar unit 14*a*. The second fixing element 44*a* is here in contact with the planar unit 14*a* on a contact surface which is arranged parallel to a main plane of extension of the second fixing element 44*a* and/or of the planar unit 14*a*. Alternatively or additionally a fixing unit, a fixing subunit and/or a second fixing element could consist of a thermally insulating material. Furthermore a second fixing element could be embodied in one piece with a first fixing element, in particular embodied in one piece with a base unit, or be identical to the first fixing element. In addition, a second fixing element could be embodied as a rivet, as a bolt element, as a snap-in element, as a spring element, as a stop element, and/or as a threaded element, advantageously internal thread element, for example nut, and/or external thread element, for example screw element. In principle it is also conceivable that a fixing unit, a fixing subunit and/or a second fixing element, in particular at least a surface layer of the second fixing element, at least on a part thereof which is in contact with a planar unit, consists of a further material which reduces static friction and/or dynamic friction.

In addition the fixing subunit 23*a* has a third fixing element 52*a*. The third fixing element 52*a* is in the present case separately embodied from the second fixing element 44*a*. Furthermore the third fixing element 52*a* is separately embodied from the first fixing element 38*a*. In the present case the third fixing element 52*a* is embodied as a nut. In the assembled state the third fixing element 52*a* is arranged on the first fixing element 38*a*, in particular the external thread 39*a*. The second fixing element 44*a* and the third fixing element 52*a* interact in the assembled state to fix the planar unit 14*a* to the base unit 16*a* in the fixing direction 22*a*. The third fixing element 52*a* is here provided to transmit a compression force to the second fixing element 44*a* in the fixing direction 22*a*. In addition, the second fixing element 44*a* is provided to transmit the compression force to the planar unit 14*a*. Alternatively, a third fixing element could be embodied as a rivet, as a snap-in element, as a spring element, as a stop element, and/or as a threaded element differing from a nut, for example a screw element. In addition, a second fixing element and/or a third fixing element could have a rectangular or oval contact surface.

In the present case the fixing unit 12*a* further has at least one second stop element 30*a*, 32*a*, 34*a* assigned to the first stop element 24*a*, 26*a*, 28*a*. In the present case the fixing unit 12*a* comprises a multiplicity of, by way of example sixteen, second stop elements 30*a*, 32*a*, 34*a*, wherein in particular in the figures only three of the second stop elements 30*a*, 32*a*, 34*a* are provided with reference characters. Viewed in the fixing direction 22*a*, the second stop elements 30*a*, 32*a*, 34*a* are arranged at a distance from each other. In the present case the second stop elements 30*a*, 32*a*, 34*a* are identically embodied as regards size, shape and orientation.

Furthermore, each of the fixing subunits 23*a*, 25*a*, 27*a* has precisely one second stop element 30*a*, so that the description that follows is once again limited to the fixing subunit 23*a*, but in principle can also be applied to the other fixing subunits 25*a*, 27*a*. The fixing subunit 23*a* has the second stop element 30*a*. The second stop element 30*a* and the first fixing element 38*a* are identical in the present case. The second stop element 30*a* is embodied as a movement-restriction element. Further, in the assembled state the second stop element 30*a* penetrates the first stop element 24*a* assigned to the second stop element 30*a* in the fixing direction 22*a*. Alternatively, at least one second stop element could be differently embodied from a first fixing element. Furthermore a fixing unit could have a number of second stop elements other than sixteen.

In addition in the assembled state the fixing unit 12*a* allows a restricted movement of the planar unit 14*a* relative to the base unit 16*a* in a direction of movement 18*a* at least essentially parallel to the main plane of extension of the planar unit 14*a*. Furthermore in the assembled state the fixing unit 12*a* allows a restricted movement of the planar unit 14*a* relative to the base unit 16*a* in a further direction of movement 20*a* at least essentially parallel to the main plane of extension of the planar unit 14*a*. The direction of movement 18*a* and the further direction of movement 20*a* are arranged perpendicularly to each other. In addition, the restricted movement is embodied as a movement on a linear movement path. In the present case a difference in the magnitude of the thermal expansion of the base unit 16*a* and of the planar unit 14*a* brings about a movement of the planar unit 14*a* and the base unit 16*a* relative to each other. Through the restricted movable mounting of the planar unit 14*a* relative to the base unit 16*a* tensions and/or deformations of the planar unit 14*a* can thus advantageously be avoided and at the same time a consistent arrangement of the planar unit 14*a* on the base unit 16*a* can be achieved. A maximum movement path of the planar unit 14*a* relative to the base unit 16*a* amounts in the present case to at least 2 mm and at most 7 mm in the direction of movement 18*a* and in the further direction of movement 20*a*.

In order to achieve this restriction of movement, in the present case the first stop elements 24*a*, 26*a*, 28*a* and the second stop elements 30*a*, 32, 34*a* interact with each other. Here in particular one of the first stop elements 24*a*, 26*a*, 28*a* interacts in each case with a corresponding second stop element 30*a*, 32, 34*a* assigned to the first stop element 24*a*, 26*a*, 28*a*. In the present case an impact of the first stop elements 24*a*, 26*a*, 28*a* on the second stop elements 30*a*, 32, 34*a* brings about the restriction of movement. Furthermore the restricted movement is predetermined by an arrangement, shape, size and orientation of the first stop elements 24*a*, 26*a*, 28*a* and the second stop elements 30*a*, 32*a*, 34*a*. Alternatively, a fixing unit could allow a restricted movement of a part of a planar unit relative to a base unit in one direction of movement only. In addition, a movement path could be embodied differently from a linear movement path, for example as a curvilinear movement path. In principle it is also conceivable that a cause other than thermal expansion, for example a mechanical force, brings about a movement of a planar unit relative to a base unit.

Figure 6:
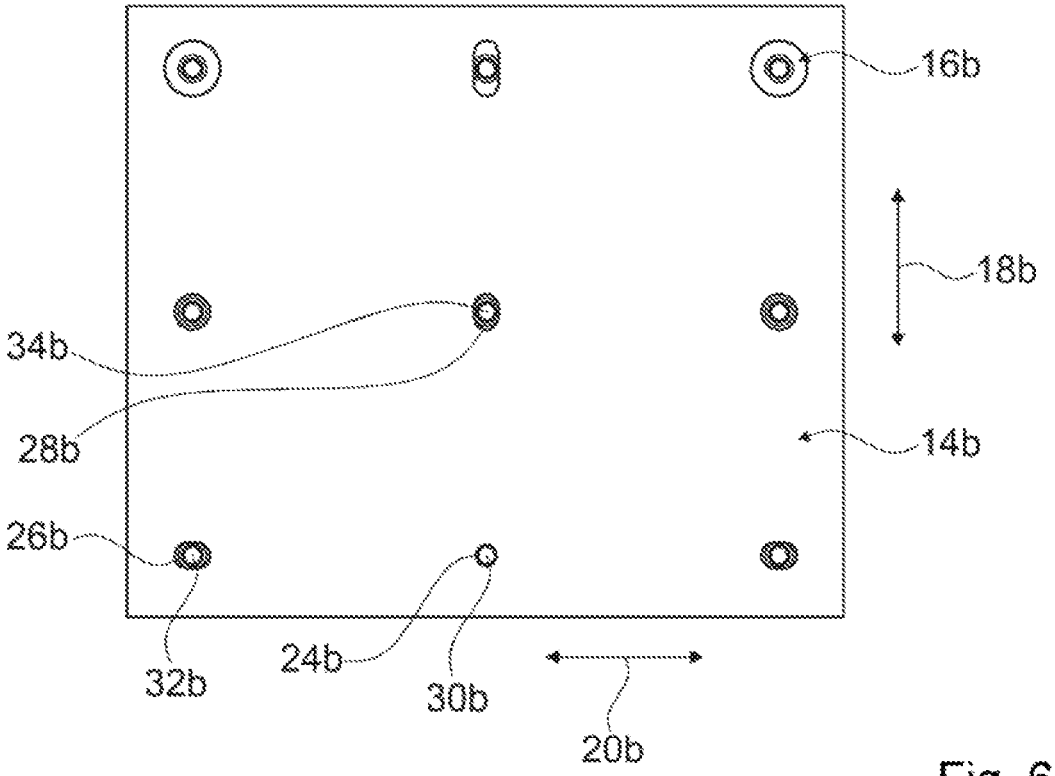
FIG. 6 shows a top view of a further exemplary embodiment of a household appliance device with a part of a fixing unit.

FIG. 6 shows a further exemplary embodiment of the invention. The alphabetic character b is appended to the reference characters of the exemplary embodiment from FIG. 6. The further exemplary embodiment from FIG. 6 differs from the previous exemplary embodiment at least essentially in terms of an embodiment of a planar unit 14*b*.

In the present case in at least one assembled state a fixing unit 12*b* allows restricted movement at least of a part of the planar unit 14*b* relative to a base unit 16*b* in a direction of movement 18*b* at least essentially parallel to a main plane of extension of the planar unit 14*b* and at least of a first further part of the planar unit 14*b* relative to the base unit 16*b* in a further direction of movement 20*b* different from the direction of movement 18*b* which is at least essentially parallel to the main plane of extension of the planar unit 14*b*. In addition in the assembled state the fixing unit 12*b* fixes a second further part of the planar unit 14*b* relative to the base unit 16*b*. In the assembled state the fixing unit 12*b* here fixes the second further part of the planar unit 14*b* relative to the base unit 16*b* in the direction of movement 18*b* and the further direction of movement 20*b*.

The planar unit 14*b* comprises, by way of example, nine first stop elements 24*b*, 26*b*, 28*b*. The first stop elements 24*b*, 26*b*, 28*b* are differently embodied as regards size, shape and orientation. Viewed in a fixing direction 22*b*, the first stop elements 24*b*, 26*b*, 28*b* are arranged distributed in a matrix-like manner over the planar unit 14*b*.

In addition, the fixing unit 12*b* comprises nine second stop elements 30*b*, 32*b*, 34*b* assigned to the first stop elements 24*b*, 26*b*, 28*b*. The second stop elements 30*b*, 32*b*, 34*b* are identically embodied as regards size, shape and orientation. Viewed in the fixing direction 22*b*, the second stop elements 30*b*, 32*b*, 34*b* are arranged distributed in a matrix-like manner over the base unit 16*b*. The second stop elements 30*b*, 32*b*, 34*b* are connected in one piece to the base unit 16*b*.

A first stop element 24*b* of the first stop elements 24*b*, 26*b*, 28*b* is mounted free of play on a corresponding second stop element 30*b* of the second stop elements 30*b*, 32*b*, 34*b*. The first stop element 24*b* is embodied in circular form. The first stop element 24*b* and the second stop element 30*b* interact to fix the second further part of the planar unit 14*b* relative to the base unit 16*b* in the direction of movement 18*b* and in particular additionally in the further direction of movement 20*b*.

In addition, further first stop elements 26*b*, 28*b* of the first stop elements 24*b*, 26*b*, 28*b* are mounted with play on assigned further second stop elements 32*b*, 34*b* of the second stop elements 30*b*, 32*b*, 34*b*. In the present case the further first stop elements 26*b*, 28*b* are embodied in an elongated or circular form, wherein in particular a diameter of the further first stop elements 26*b*, 28*b* is greater than a diameter of the further second stop elements 32*b*, 34*b*. The further first stop elements 26*b*, 28*b* are provided, together with the further second stop elements 32*b*, 34*b*, to allow to a restricted movement of the planar unit 14*b*, in particular of the part of the planar unit 14*b* and of the first further part of the planar unit 14*b*, relative to the base unit 16*b*.

In the present case one of the further first stop elements 26*b* is provided to allow a restricted movement of the planar unit 14*b* relative to the base unit 16*b* in the direction of movement 18*b*, while another of the further first stop elements 28*b* is provided to allow to a restricted movement of the planar unit 14*b* relative to the base unit 16*b* in the further direction of movement 20*b*.

Figure 7:
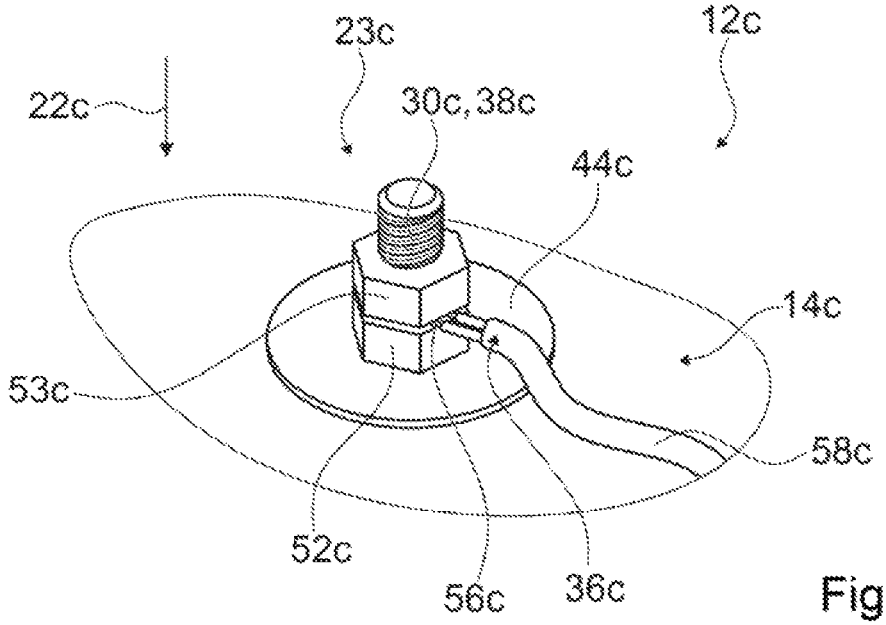
FIG. 7 shows a further exemplary embodiment of the household appliance device with a part of a fixing unit in a perspective representation.

FIG. 7 shows a further exemplary embodiment of the invention. The alphabetic character c is appended to the reference characters of the exemplary embodiment from FIG. 7.

In the present case the household appliance device has a temperature sensor 36*c*, which is connected to the fixing unit 12*c*. The temperature sensor 36*c* is embodied as an electronic temperature sensor. For example the temperature sensor 36*c* is embodied as a resistance temperature sensor. To this end the temperature sensor 36*c* has a resistance wire 56*c*. The resistance wire 56*c* has a temperature-dependent ohmic resistance. The resistance wire 56*c* is enclosed by an electrically insulating cable insulation 58*c*. Furthermore the resistance wire 56*c* is attached to a first fixing element 38*c* with two third fixing elements 52*c*, 53*c*. Advantageously the temperature sensor 36*c* is arranged in the area of a second further part of a planar unit 14*c*. Furthermore the temperature sensor 36*c* is in particular thermally coupled with the base unit 16*c*. The temperature sensor 36*c* is provided to record, measure and/or determine a temperature of the base unit 16*c* in at least one operating status. Alternatively, a temperature sensor could however also be embodied as any temperature sensor known per se and other than a resistance temperature sensor.

Figure 8:
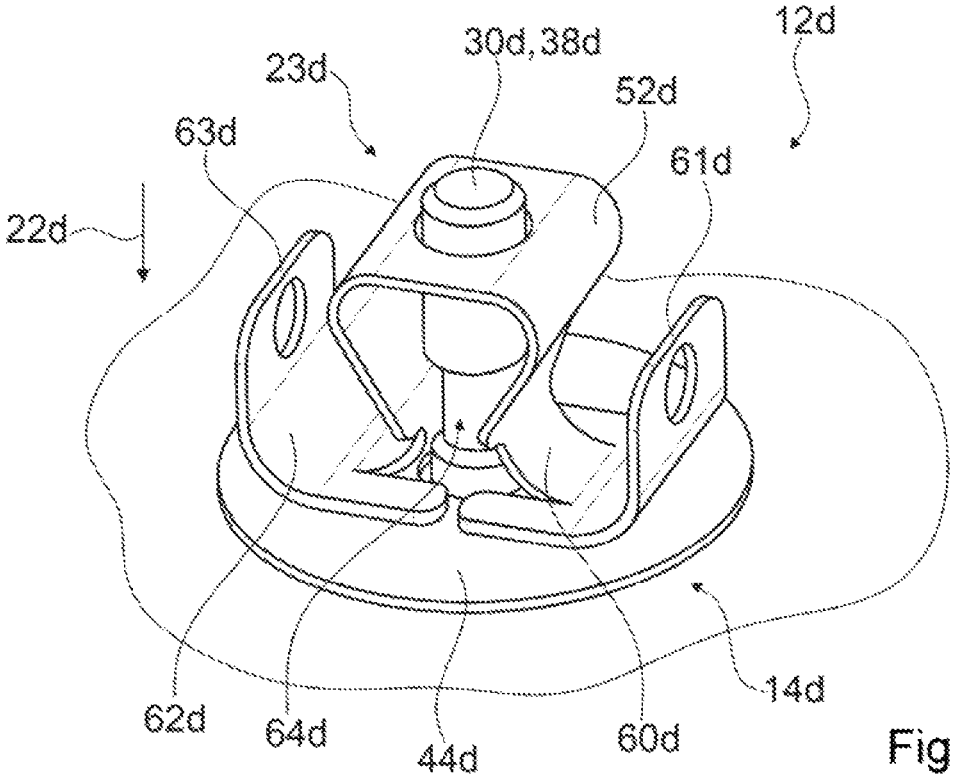
FIG. 8 shows a further exemplary embodiment of the household appliance device with a part of a fixing unit in a perspective representation and FIG. 9 shows a further exemplary embodiment of the household appliance device with a part of a fixing unit in a perspective representation.

FIG. 8 shows a further exemplary embodiment of the invention. The alphabetic character d is appended to the reference characters of the exemplary embodiment from FIG. 8. The further exemplary embodiment from FIG. 8 differs from the previous exemplary embodiment at least essentially in terms of an embodiment of a fixing unit 12*d*.

In the present case a fixing subunit 23*d* of the fixing unit 12*d* has a first fixing element 38*d* embodied as a threadless bolt element. The first fixing element 38*d* has a notch 64*d*. The notch 64*d* is arranged in a central part of the first fixing element 38*d* arranged between a first end and a second end.

Furthermore the fixing subunit 23*d* has a third fixing element 52*d* embodied as a snap-in element. The third fixing element 52*d* has two wings 60*d*, 62*d*. During assembly the wings 60*d*, 62*d* engage in the notch 64*d*. Furthermore the wings 60*d*, 62*d* fix the third fixing element 52*d* in a fixing direction 22*d*. A first wing end 61*d* of a first wing 60*d* of wings 60*d*, 62*d* faces away from is the first fixing element 38*d*. Furthermore a second wing end 63*d* of a second wing 62*d* of the wings 60*d*, 62*d* faces away from the first fixing element 38*d*. The wings 60*d*, 62*d* are provided to exert a compression force on a second fixing element 44*d* in the fixing direction 22*d*.

Figure 9:
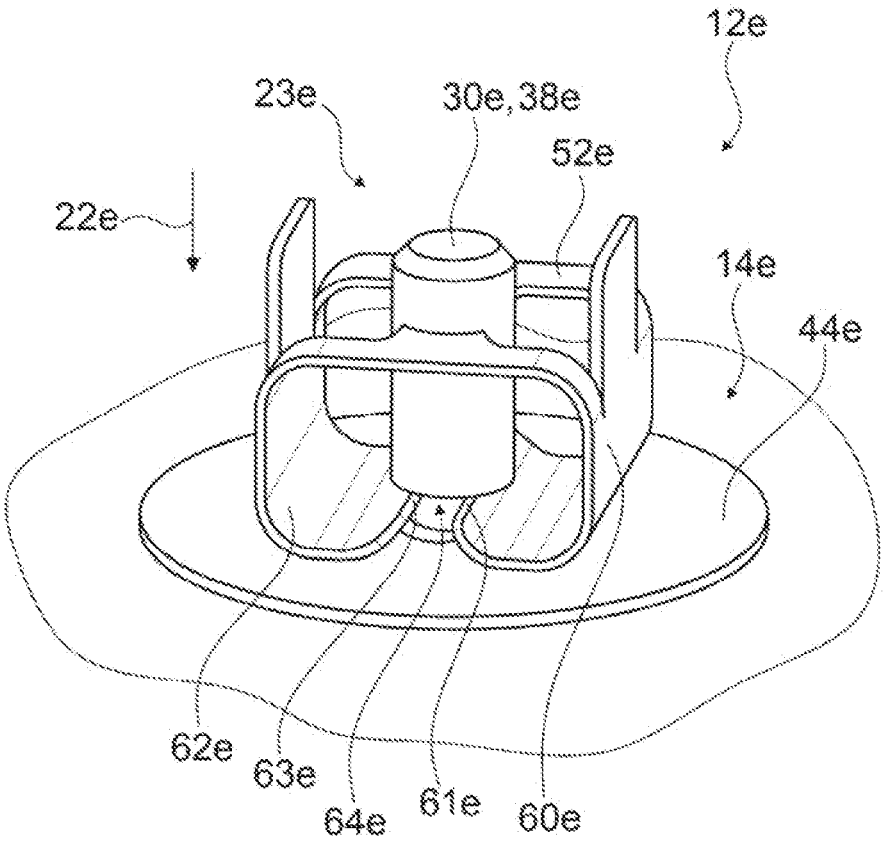

FIG. 9 shows a further exemplary embodiment of the invention. The alphabetic character e is appended to the reference characters of the exemplary embodiment from FIG. 9. The further exemplary embodiment from FIG. 9 differs from the previous exemplary embodiment at least essentially in terms of an embodiment of a fixing unit 12*e*.

In the present case a fixing subunit 23*e* of the fixing unit 12*e* has a first fixing element 38*e* embodied as a threadless bolt element. The first fixing element 38*e* has a notch 64*e*. Furthermore the fixing subunit 23*e* has a third fixing element 52*e* embodied as a snap-in element. The third fixing element 52*e* has two wings 60*e*, 62*e*. During assembly, the wings 60*e*, 62*e* engage in the notch 64*e*. Furthermore the wings 60*e*, 62*e* fix the third fixing element 52*e* in a fixing direction 22*e*. The wings 60*e*, 62*e* are provided to exert a compression force on a second fixing element 44*e* in the fixing direction 22*e*.

The notch 64*e* embodies a part of the first fixing element 38*e* facing towards the planar unit 14*e*. A first wing end 61*e* of a first wing 60*e* of wings 60*e*, 62*e* faces towards the first fixing element 38*e*. In an assembled state the first wing end 61*e* of the first wing 60*e* engages in the notch 64*e*. Furthermore is a second wing end 63*e* of a second wing 62*e* of wings 60*e*, 62*e* faces towards the first fixing element 38*e*. In the assembled state the second wing end 63*e* of the second wing 62*e* engages in the notch 64*e*.

The invention claimed is:

1. A household appliance device, comprising:

a base unit;

a planar unit, the planar unit being an induction heating unit; and a fixing unit configured to at least partially fix the planar unit to the base unit such that in an assembled state the fixing unit allows restricted movement at least of a part of the planar unit relative to the base unit in a direction of movement at least essentially parallel to a main plane of extension of the planar unit, wherein the planar unit includes a plurality of first stop elements distributed over the planar unit, and the fixing unit includes a plurality of second stop elements distributed over the fixing unit and assigned to the plurality of first stop elements and interacting with the plurality of first stop elements to restrict movement of the planar unit, wherein the plurality of first stop elements includes a plurality of openings distributed over the planar unit, and wherein the plurality of second stop elements includes a threadless bolt element having a notch, and the fixing unit further comprises a snap in element having wings engaging the notch of the threadless bolt element such that the fixing unit fixes the planar unit to the base unit in a fixing direction oriented perpendicularly to the main plane of extension of the planar unit.

2. The household appliance device of claim 1, wherein a maximum movement path of the part of the planar unit relative to the base unit in the direction of movement amounts to at least 1 mm.

3. The household appliance device of claim 1, wherein in the assembled state the fixing unit allows a restricted movement of at least a first further part of the planar unit relative to the base unit in a further direction of movement at least essentially parallel to the main plane of extension of the planar unit, wherein the further direction of movement is different from the direction of movement.

4. The household appliance device of claim 3, wherein in the assembled state the fixing unit at least essentially fixes a second further part of the planar unit relative to the base unit.

5. The household appliance device of claim 1, wherein the fixing unit is configured to fix the planar unit to the base unit in a fixing direction oriented perpendicularly to the main plane of extension of the planar unit.

6. The household appliance device of claim 1, wherein the fixing unit is made at least partially of electrically insulating material.

7. The household appliance device of claim 1, wherein the fixing unit is embodied at least partially in one piece with the base unit.

8. The household appliance device of claim 1, wherein the plurality of first stop elements are arranged at a distance from each other and configured differently as regards size, shape and/or orientation.

9. The household appliance device of claim 1, wherein the base unit is embodied as a muffle wall.

10. The household appliance device of claim 1, further comprising a temperature sensor, which is connected to the fixing unit.

11. A household appliance, comprising a household appliance device, said household appliance device comprising a base unit, a planar unit embodied as an induction heating unit, and a fixing unit configured to at least partially fix the planar unit to the base unit such that in an assembled state the fixing unit allows restricted movement at least of a part of the planar unit relative to the base unit in a direction of movement at least essentially parallel to a main plane of extension of the planar unit, wherein the planar unit includes a plurality of first stop elements distributed over the planar unit, and the fixing unit includes a plurality of second stop elements distributed over the fixing unit and assigned to the plurality of first stop elements and interacting with the plurality of first stop elements to restrict movement of the planar unit, wherein the plurality of first stop elements includes a plurality of openings distributed over the planar unit, and wherein the plurality of second stop elements includes a threadless bolt element having a notch, and the fixing unit further comprises a snap in element having wings engaging the notch of the threadless bolt element such that the fixing unit fixes the planar unit to the base unit in a fixing direction oriented perpendicularly to the main plane of extension of the planar unit.

12. The household appliance of claim 11, wherein a maximum movement path of the part of the planar unit relative to the base unit in the direction of movement amounts to at least 1 mm.

13. The household appliance of claim 11, wherein in the assembled state the fixing unit allows a restricted movement of at least a first further part of the planar unit relative to the base unit in a further direction of movement at least essentially parallel to the main plane of extension of the planar unit, wherein the further direction of movement is different from the direction of movement.

14. The household appliance of claim 13, wherein in the assembled state the fixing unit at least essentially fixes a second further part of the planar unit relative to the base unit.

15. The household appliance of claim 11, wherein the fixing unit is configured to fix the planar unit to the base unit in a fixing direction oriented perpendicularly to the main plane of extension of the planar unit.

16. The household appliance of claim 11, wherein the fixing unit is made at least partially of electrically insulating material.

17. The household appliance of claim 11, wherein the fixing unit is embodied at least partially in one piece with the base unit.

18. The household appliance of claim 11, wherein the plurality of first stop elements are arranged at a distance from each other and configured differently as regards size, shape and/or orientation, and wherein one of the plurality of first stop elements is configured with a circular form and another of the plurality of first stop elements is configured with an elongated form.

19. The household appliance of claim 11, wherein the base unit is embodied as a muffle wall.

20. The household appliance of claim 11, wherein the household appliance device includes a temperature sensor, which is connected to the fixing unit.

21. The household appliance device of claim 1, wherein the plurality of first stop elements are arranged at a distance from each other and configured identically as regards size, shape and/or orientation.

22. The household appliance device of claim 21, wherein the plurality of first stop elements are configured with a circular form.

* * * * *